United States Patent [19]

Deleris

[11] Patent Number: 5,050,878

[45] Date of Patent: Sep. 24, 1991

[54] HOCKEY STICK MADE OF COMPOSITE MATERIALS AND ITS MANUFACTURING PROCESS

[75] Inventor: Claude Deleris, Montauban, France

[73] Assignee: Destra S.A., Montech, France

[21] Appl. No.: 418,540

[22] Filed: Oct. 10, 1989

[30] Foreign Application Priority Data

Oct. 7, 1988 [FR] France ..... 88 13391

[51] Int. Cl.[5] ..... A63B 59/12

[52] U.S. Cl. ..... 273/67 A; 273/67 R; 273/72 R

[58] Field of Search ..... 273/67 A, 73 F, 67 R, 273/72 R, 80 R, 80 B, 67 DA

[56] References Cited

U.S. PATENT DOCUMENTS

| | | | |
|---|---|---|---|
| 3,691,000 | 9/1972 | Kalnin | 273/73 F |
| 3,755,037 | 8/1973 | Erwin et al. | 273/73 F |
| 3,770,033 | 11/1973 | Gauillet et al. | 273/73 F |
| 4,148,482 | 4/1979 | Harwell | 273/67 A |
| 4,200,479 | 4/1980 | Ardell et al. | 273/67 A |
| 4,358,113 | 11/1982 | Mckinnon et al. | 273/67 A |
| 4,429,873 | 2/1984 | Van Raemdonck | 273/73 F |
| 4,468,032 | 11/1990 | Ledekop | 273/67 A |
| 4,537,398 | 8/1985 | Salminen | 273/67 A |
| 4,591,155 | 5/1986 | Adachi | 273/67 A |

FOREIGN PATENT DOCUMENTS

| | | | |
|---|---|---|---|
| 1063747 | 10/1979 | Canada | 273/67 A |
| 2005952 | 10/1971 | Fed. Rep. of Germany | 273/67 A |
| 2911512 | 10/1979 | Fed. Rep. of Germany | 273/67 A |
| 3437165 | 4/1986 | Fed. Rep. of Germany | 273/67 A |
| 2594345 | 8/1987 | France | 273/73 F |
| 2201117 | 8/1988 | United Kingdom | 273/67 A |

*Primary Examiner*—Edward M. Coven
*Assistant Examiner*—Mark S. Graham
*Attorney, Agent, or Firm*—Sandler, Greenblum & Bernstein

[57] ABSTRACT

Composite hockey stick includes an expanded polyvinylchloride foam core in the shape of a handle attached to a blade, a first mesh composed of at least one of fiberglass and carbon fibers tightly surrounding at least a portion of the expanded polyvinylchloride foam core, and at least one additional mesh composed of at least one of fiberglass and carbon fibers tightly surrounding at least a portion of the first mesh. Preferably, each mesh in a direction outwardly from the core has a greater weaving angle with respect to the core than a preceding mesh, to thereby provide an offsetting of threads of one mesh to another.

16 Claims, 1 Drawing Sheet

HOCKEY STICK MADE OF COMPOSITE MATERIALS AND ITS MANUFACTURING PROCESS

BACKGROUND OF THE INVENTION

1. Field of the Invention

The present invention relates to a hockey stick made of composite materials and its manufacturing process.

2. Discussion of Background and Relevant Information

Hockey sticks existing on the market are either of wood or composite materials, or associate the two materials.

With respect to playing comfort, wooden sticks give good results, however, they are very expensive and subject to variations in their structure with respect to playing conditions, such as temperature and humidity.

Existing sticks of composite materials have a cost lower than that of wood but do not bring the same playing comfort to the user because they require a period of adaptation.

In addition, this type of stick has the disadvantage of often deforming after a certain time because of the usage of certain polymers which are naturally unstable.

Sticks alloying wood and composite materials deteriorate rapidly because of the fact of the influx of different materials whose bonding is more fragile as blows are repeated.

The present invention aims to overcome the disadvantages cited by proposing a hockey stick of composite materials having a weight equivalent to that of a wooden stick and thus offering to the user the same sensations, being of a very great sturdiness while furnishing great playing comfort and having a very stable structure under various weather conditions.

To that end, the stick of composite materials according to the invention provided with a shaft and a blade is essentially characterized in that it comprises a core of expanded polyvinylchloride foam having the general shape of the stick, a first mesh of fiberglass or carbon fibers in which the core is placed and gripped and at least one other fiberglass or carbon fiber mesh in which the core provided with the first mesh, is placed and gripped.

BRIEF DESCRIPTION OF THE DRAWINGS

Other advantages and characteristics will appear from the description of the invention shown in the annexed drawings given by way of non-limiting example, and in which.

Figure 1:
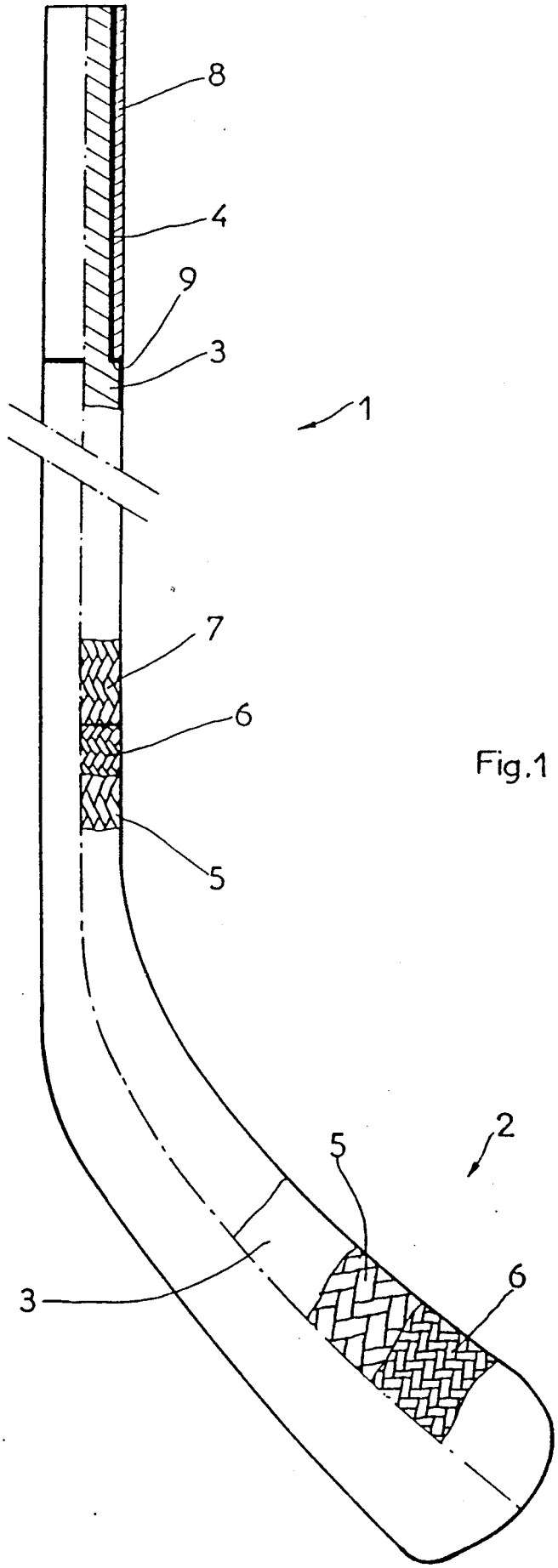
FIG. 1 is a view of the stick assembly according to the invention.

The hockey stick of composite materials comprises in a known manner a handle 1 by which said stick is held and a blade 2 at the end of the handle by means of which the player strikes the ball, puck or other object.

The stick of composite materials is generally provided with a core 3 and a coating 4 covering all or part of the core 3.

The hockey stick according to the invention comprises a core 3 of expanded polyvinylchloride (PVC) or PVC having the general shape of the stick to be obtained, a first mesh 5 of fiberglass or carbon fibers in which is placed and gripped the core 3 and at least one other mesh 6 of fiberglass or carbon fibers in which is placed the core 3 provided with the first mesh 5.

The core 3 of polyvinylchloride (PVC) foam offers in weather a very great stability since the PVC is a very stable material in itself and which cannot thus sustain modifications in normal conditions of usage.

Depending on the size and weight of the player the physical characteristics of the core must be modified. One of the base characteristics for the selection of the PVC foam is the resistance to penetration which is between 50 and 100 kg/cm$^2$ for the stick according to the invention.

The core 3 of PVC has the general shape of the stick to be obtained and is preferably made all in one piece.

The section of core 3 at the level of handle 1 of the stick is rectangular and constant over almost the entire length of the handle, then decreases progressively to be flattened at the level of the stick blade. This blade is curved in a known fashion in its plane. The length of the handle 1 is adapted to the player. The structure of core 3 of PVC foam is alveolate and the resistance to penetration defines the size of the cells of the foam.

Thus a decrease in the size of cells corresponds to increase in resistance to penetration. A first mesh 5 of fiberglass or carbon fibers is placed on core 3.

This first mesh 5 is joined to core 3 so as to cover the entire length thereof since it is pressed against core 3 by pulling on its ends.

The weaving angle of mesh 5 varies between its initial position and its final position on the mesh.

In fact, so that core 3 passes easily in mesh 5 then the latter is pressed against said core 3, it is necessary that the weaving angle with respect to the longitudinal axis of the mesh vary. This angle between the initial position and the final position on core 3 varies of a value which is a function of the section of the core.

Once in place on core 3, this first mesh 5 is maintained pressed and solidly affixed to said core by means which will be described below.

At least one other mesh 6 of the same type but which can be of different material is or joined over the entire length to core 3 provided with the first mesh 5 and is pressed against the latter, and solidly affixed thereto by means described below.

So as to simplify the description and without being limiting, a single other mesh 6 is joined to the core 3/first mesh 5 assembly.

This other mesh 6 is of the same type as the first mesh 5 and is placed on a section more significant than the first mesh. Moreover, the variation of the weaving angle with respect to its longitudinal axis between its initial position and its final position on core 3 and mesh 5 is different.

Thus by comparison and from a single initial weaving angle, the angle of threads with respect to the longitudinal axis will be less on the first mesh 5 than on the other mesh 6.

Therefore, in the final position, the mesh found closest to the exterior and thus over the largest section will have a weaving angle in final position which is greater with respect to that of the preceding meshes while considering the initial weaving angles of different identical meshes. These differences of weaving angles of meshes 5 and 6 in final position creates an offsetting of the threads of one mesh to another, which has the effect of reinforcing the structure.

The stick of composite materials with respect to the user's morphology to which it is adapted can comprise two or three meshes about core 3 without this constituting a limit.

Preferentially, at least one mesh is of fiberglass and at least one mesh is of carbon fibers and their position with respect to one another and with respect to core 3 defines the characteristics of stiffness, elasticity and durability of the stick according to the invention.

In a known manner, carbon fiber provides qualities of stiffness through its high resistance to pulling and fiberglass gives good elasticity.

According to a first embodiment of the stick according to the invention, the first mesh 5 is of fiberglass and the second mesh 6 is of carbon fibers. According to this embodiment because of the exterior position of the carbon fibers mesh, the stick has a good quality of stiffness.

According to a second embodiment of the stick, the first mesh 5 is of carbon fibers and the second mesh 6 is of fiberglass to confer the stick with good elasticity.

A third mesh of fiberglass or carbon fibers can be added to the two first meshes as a function of the characteristics of stiffness and elasticity to be obtained in the stick.

The fiberglass mesh has a G.S.M., i.e., a weight per meter, between 115 and 130 grams for a diameter between 40 and 50 mm. Preferentially, the fiberglass mesh is made with a number of threads between 550 and 600. The initial weaving angle of the mesh is preferably between 45° and 55°. This weaving angle when the mesh is in place on the stick is between 30° and 45° with respect to the longitudinal axis of stick handle 1 and between 45° and 55° with respect to the longitudinal axis of blade 2 of said stick. In the stick blade, the angle with respect to the longitudinal axis of the blade can be different for intersecting threads because of the shape of the blade and the structure of the mesh.

The carbon fiber mesh used in the stick according to the invention preferably has a G.S.M. between 55 and 65 g for a diameter between 40 and 50 mm. This mesh is made with a weaving angle between 45° and 50° and comprises a number of threads between 90 and 100. Each thread of mesh used in the stick according to the invention comprises approximately 6,000 filaments. These initial characteristics of the carbon mesh make it possible to obtain in the cross an angle with respect to the longitudinal axis of the stick between 20° and 30° in the handle 1 and between 50° and 60° in blade 2.

According to another embodiment of the stick according to the invention, the latter can comprise at least one mesh in which are associated carbon fibers and fiberglass.

It goes without saying that these mesh characteristics given above are adapted to hockey sticks having the most widely used section and that these initial characteristics can be modified with respect to the section of core 3 on which the meshes are to be placed.

Still depending on the player's morphology to which the stick is adapted and depending on the pressures of the player with respect to the stick, the latter can receive at least one reinforcement 7 in the locations of the stick subject to more significant physical stresses. This at least one reinforcement 7 of the stick according to the invention can be constituted by at least one mesh of aramid fibers joined to core 3 and meshes 5 and 6 on the zone or zones of great stresses.

In a general manner, a reinforcement 7 is necessary in the zone where the player holds the stick closest to the blade 2 on handle 1. In fact, during the striking of the puck a significant flexion occurs in this holding zone.

While considering the current section of existing sticks, the mesh of aramid fibers known under the commercial name of "KEVLAR" has a G.S.M. between 50 and 55 g and a diameter from 55–65 mm.

The "KEVLAR" mesh used as reinforcement 7 in the stick according to the invention has a weaving angle between 55° and 60° initially and between 20° and 30° in position in handle 1 of the stick. Preferentially, this "KEVLAR" mesh is obtained with a number of threads between 185 and 200.

Another zone of the stick receiving great stresses is the zone for striking the puck, i.e., the blade. A reinforcement 7 can be placed in this zone so as to protect it. The forces on the blade being different from those exerted on the handle, reinforcement 7 can be constituted in this case by a fiberglass mesh joined to the stick blade. In certain cases, the blade 2 can receive likewise a "KEVLAR" mesh.

The meshes 5 and 6 are joined to one another on core 3 of PVC then stretched thereon and the reinforcement(s) 7 are positioned by joining under tension.

Meshes 5 and 6 and reinforcement(s) 7 are solidly affixed to one another and on core 3 of PVC by a resin of the epoxy type with which the core 3 is previously impregnated, then meshes 5 and 6 and reinforcement(s) 7. This bonding resin makes it possible to obtain perfect bonding of the assembly in the stick according to the invention.

Preferably, on the end of stick handle 1 according to the invention is affixed in the extension of the handle surface, a layer 8 of an easily preformed soft material. This layer 8 is constituted by wood which can be easily worked so the player can adapt it to his handle grip.

To receive this wooden layer 8, core 3 comprises a break 9 at a certain distance from the end in which is lodged the wooden layer 8.

The latter is affixed above the meshes 5 and 6 which follow the shape of core 3, and thus of the break 9, and is connected thereto by the resin.

Meshes 5 and 6 are cut throughout core 3 when they are put in place thereon or can be of a length slightly greater than that of core 3 to be folded over the ends of the core.

According to a particular arrangement, meshes 5 and 6 go beyond blade 2 to be connected to one another or to form an extension of blade 2, and so as to have a section substantially identical to that of the blade. This extension, in the heart of which core 3 does not extend, can be shaped by the user according to his requirements.

The stick according to the invention has good qualities as to its weight, its stiffness, its elasticity and its playing comfort which allows perfect control of the puck or the element to be played.

This stick is likewise insensitive to any variations in humidity and ambient temperature.

The process to obtain the stick of composite materials according to the invention consists, according to a first embodiment, of cutting a volume of PVC foam, machining this volume according to the shape of a stick to form core 3 thereof, impregnating the core with an epoxy type resin, joining the first precut mesh 5 to core 3, and stretching the first mesh on the core, impregnating with resin the first mesh 5, joining the other mesh or meshes 6 and stretching them on core 3 and mesh 5, impregnating with epoxy resin before the placement of the mesh following the preceding mesh, possibly placing reinforcements 7, impregnating them with resin, placing layer 8 of soft material, positioning the entirety in a mold where the polymerization of the resin is achieved, and achieving the completion of the stick by the adjustment of its ends and its lacquering.

According to a second preferred embodiment of the manufacturing process of the stick according to the invention, after cutting and machining of core 3, the process consists of joining to the core all meshes 5 and 6 and stretching them over core 3, joining the reinforcement(s) 7, placing layer 8 of soft material on handle 1, placing the assembly in a hermetic mold, creating a vacuum in the mold, injecting the epoxy type resin into the mold, subjecting the resin to polymerization and ensuring the finishing of the stick.

The volume of PVC foam is cut in a conventional manner by sawing or by cutting by laser or high pressure water spray or other and core 3 is machined by any known means such as milling. The curve of the blade 2 is obtained by passage into the form and heating.

The quantity of epoxy type resin is variable according to the resistance of the foam and according to the thickness of the meshes.

A core 3 of low resistance has cells which are larger than a core of high resistance and thus retains a greater quantity of resin on the surface.

A thick mesh likewise retains more resin than a mesh of lesser thickness.

In the resin is mixed a hardener which polymerizes in the mold in which the core 3 provided with its coating 2 is placed. This polymerization can be accelerated by heating of the mold and has an influence on the final physical characteristics of the stick.

In fact, in the case of a moderate heating, carbon fibers have a greater mechanical resistance to pulling than in the case of a polymerization at ambient temperature.

The mold in which the polymerization of the resin occurs compresses the stick to give it a good surface condition.

The stick according to the invention after molding undergoes finishes consisting of cutting of possible resin burrs, mesh thread on the ends, then is lacquered to give it its final exterior aspect.

The stick of composite materials according to the invention re-creates the sensation of playing with a conventional wooden stick without comprising the deficiencies, has good flexibility, offers better restoration of lunging power, increased mechanical resistance to shocks and deformations and good responsiveness.

The present invention has for its object a hockey stick whose manufacturing process and means which are implemented can likewise find application in sticks for ice hockey as well as field hockey, in rink-hockey sticks, in polo mallets and baseball bats and any other implements for equivalent uses.

It goes without saying that the present invention can receive any adjustments and alternatives in the domain of technical equivalents without going beyond the scope of the present patent.

I claim:

1. Composite hockey stick comprising an expanded polyvinylchloride foam core substantially in the shape of an elongate handle attached to a blade; a first mesh composed of at least one of fiberglass and carbon fibers tightly surrounding at least a portion of said expanded polyvinylchloride foam core; at least one additional mesh composed of at least one of fiberglass and carbon fibers tightly surrounding at least a portion of said first mesh; and each mesh in a direction outwardly from said core has a greater weaving angle with respect to the longitudinal axis of said core than a preceding mesh, to thereby provide an offsetting of threads of one mesh to another.

2. The stick according to claim 1, wherein said first mesh is composed of fiberglass, and said at least one additional mesh is composed of carbon fibers.

3. The stick according to claim 1, wherein said first mesh is composed of carbon fibers, and said at least one additional mesh is composed of fiberglass.

4. The stick according to claim 1, wherein said expanded polyvinylchloride foam core has a resistance to penetration of between 50 and 100 kg/cm$^2$.

5. The stick according to claim 1, wherein, when said first mesh or said at least one additional mesh comprises fiberglass, said fiberglass mesh has a G.S.M. between 115 and 130 g/m for a diameter between 40 and 50 mm, includes a number of threads between 550 and 600, and an initial weaving angle between 45° and 55°, and a final weaving angle when said fiberglass mesh is in place on said core between 30° and 45° with respect to the longitudinal axis of said handle, and 45° and 55° with respect to the longitudinal axis of said blade.

6. The stick according to claim 4, wherein, when said first mesh or said at least one additional mesh comprises fiberglass, said fiberglass mesh has a G.S.M. between 115 and 130 g/m for a diameter between 40 and 50 mm, includes a number of threads between 550 and 600, and an initial weaving angle between 45° and 55°, and a final weaving angle when said fiberglass mesh is in place on said core between 30° and 45° with respect to the longitudinal axis of said handle, and 45° and 55° with respect to the longitudinal axis of said blade.

7. The stick according to claim 1, wherein, when said first mesh or said at least one additional mesh comprises carbon fibers, said carbon fiber mesh has a G.S.M. between 55 and 65 g/m for a diameter between 40 and 50 mm, includes a number of threads between 90 and 100, with each thread comprising approximately 6,000 filaments, and an initial weaving angle between 45° and 50°, and a final weaving angle between 20° and 30° with respect to the longitudinal axis of said handle, and 50° and 60° with respect to the longitudinal axis of said blade.

8. The stick according to claim 4, wherein, when said first mesh or said at least one additional mesh comprises carbon fibers, said carbon fiber mesh has a G.S.M. between 55 and 65 g/m for a diameter between 40 and 50 mm, includes a number of threads between 90 and 100, with each thread comprising approximately 6,000 filaments, and an initial weaving angle between 45° and 50°, and a final weaving angle between 20° and 30° with respect to the longitudinal axis of said handle, and 50° and 60° with respect to the longitudinal axis of said blade.

9. The stick according to claim 1, further including at least one reinforcement in at least one zone where the stick is subjected to substantial physical stress.

10. The stick according to claim 9, wherein said at least one reinforcement comprise at least one aramid fiber mesh.

11. The stick according to claim 1, further including a layer of an easily preformed soft material on an end of said handle remote from said blade.

12. The stick according to claim 11, wherein said easily preformed soft material comprises wood.

13. The stick according to claim 1, wherein said core, said first mesh, and said at least one additional mesh are bonded to each other.

14. The stick according to claim 13, wherein said bonding comprises an epoxy resin.

15. The stick according to claim 9, wherein said core, said first mesh, said at least one additional mesh, and said reinforcement are bonded to each other.

16. The stick according to claim 15, wherein said bonding comprises an epoxy resin.

* * * * *